US005960967A

United States Patent [19]

Neil

[11] Patent Number: 5,960,967

[45] Date of Patent: Oct. 5, 1999

[54] TRACK AND HOOK ARRANGEMENT FOR STORING A VARIETY OF ARTICLES

[76] Inventor: George Albert Neil, 2951 Riverside Drive, Apt. 1214, Ottawa, Ontario, KlV 8W6, Canada

[21] Appl. No.: 09/090,836

[22] Filed: Jun. 4, 1998

[30] Foreign Application Priority Data

Dec. 5, 1997 [CA] Canada ..... 2223852

[51] Int. Cl.[6] ..... A47H 1/00

[52] U.S. Cl. ..... 211/94.01

[58] Field of Search ..... 211/94.01, 162

[56] References Cited

U.S. PATENT DOCUMENTS

| | | | |
|---|---|---|---|
| 2,715,966 | 8/1955 | Tieck | 211/94 |
| 3,027,015 | 3/1962 | Miller | 211/94 |
| 3,339,749 | 9/1967 | Odegaard et al. | 211/94 |
| 3,664,512 | 5/1972 | Smith | 211/113 |
| 4,693,381 | 9/1987 | Lodge | 211/94 |
| 5,429,252 | 7/1995 | Liu | 211/94 |

FOREIGN PATENT DOCUMENTS

| | | | |
|---|---|---|---|
| 949498 | 6/1974 | Canada | 211/24 |
| 1235673 | 4/1988 | Canada | 211/6 |

*Primary Examiner*—Alvin Chin-Shue
*Assistant Examiner*—Sarah Purol
*Attorney, Agent, or Firm*—Jones, Tullar & Cooper, PC

[57] ABSTRACT

An arrangement for storing a variety of articles, including articles held by cards, such as those of blister packages, having apertures. The arrangement comprises a normally horizontally extending elongated track member having an elongated internal cavity including a slideway communicating with an outside of the track member via a slot. A series of hook elements each has an anchor part slidably retained in the slideway, and has a shank extending from the anchor part through the slot and terminating in a hook part outside the track member, this hook part being suitable for suspending the cards by their apertures while allowing individual removal of the cards. The hook elements and the cavity, or another cavity in the track member, are dimensioned to allow the hook elements to be packaged entirely within such cavity for shipping.

3 Claims, 3 Drawing Sheets

TRACK AND HOOK ARRANGEMENT FOR STORING A VARIETY OF ARTICLES

BACKGROUND OF THE INVENTION

1. Field of the Invention

The present invention relates to an arrangement or apparatus for the storage of articles, generally in the home and especially in a home workshop. The apparatus can be used with many different types of articles, provided that they have an aperture or similar capability for receiving a hook. The apparatus is particularly useful for small articles which are commonly sold in carded packages, i.e. on cards or in "blister" packages which have an aperture in the top of the cards.

2. Prior Art

Presently, many small hardware items such as screws, brackets, hinges, batteries, etc. are sold in carded packages. Such packages cannot readily be stacked, and are difficult to organize. In stores such packages are held by horizontal rods which pass through the cards, but such an arrangement is not suitable for the home workshop since it only allows removal of the cards in sequence.

SUMMARY OF THE INVENTION

The present invention allows the visible storage of many different carded packages, allows them to be inspected and sorted, and allows removal of any card without removing others. The arrangement also allows for storage of items such as tools, for example wrenches, which are not carded but which have an aperture or like capability by which they can be hung from a hook.

In accordance with one aspect of the invention, an arrangement for storing a variety of articles, including articles held by cards having apertures, comprises:

a normally horizontally extending elongated track member having elongated internal cavity means, the cavity means including a slideway communicating with an outside surface of the track member via a slot extending along the member, supporting means attachable to structure such as a wall, ceiling or shelf and capable of supporting the track member horizontally;

a series of hook elements each having an anchor part retained in the slideway, and each having a shank extending through said slot and terminating in a hook part below the track member, said hook part being suitable for suspending cards by their apertures while allowing individual removal thereof.

A special feature of this invention is that, to facilitate packaging and shipping, the hook elements and the cavity means are dimensioned to allow the hook elements to be packaged entirely within the cavity means. The hook elements are suitable for removal from the cavity means by the purchaser and for re-arrangement in the operative position with their anchor parts only in the cavity means. The hook elements may be retained in the cavity means by end caps removably secured to ends of the track member to close the ends of the cavity having the hook elements.

Preferably, the track member is formed of extruded plastic material. Its supporting means may be attachable to a wall, and it may have an upper surface suitable for providing a shelf. In one arrangement, the track member has a first slot communicating with the slideway, which slot is on the underside of the member when the track member is in a first orientation and attached to a ceiling, and has a second slot communicating with a second slideway which slot is on the underside when the member is in a second orientation, 90° from the first orientation, and attached to a wall.

The anchor parts of the hook elements may be non-circular and arranged to be non-rotatably held by the slideway while the hook parts extend at least partially lengthwise of the track member. Normally, at least some hook elements have their upper ends spaced at least ½ inch from the track member, so as to be suitable for holding carded merchandise.

In a preferred arrangement, the slot is located in a side of the track member, having its lower edge defined by a side wall portion of the track member, and the anchor parts of the hook member are bent over retaining portions of the members which engage the inside of the wall portion.

The track member may be square in cross-section, and the supporting means may be two end brackets each having an inner end with means, for example screw holes, for attachment of the brackets to a wall or ceiling, and each having an outer end provided with a square socket for receiving an end of the track member.

BRIEF DESCRIPTION OF THE DRAWINGS

Preferred embodiments of the invention will now be described by way of example with reference to the accompanying drawings, in which.

DETAILED DESCRIPTION

Figure 1:
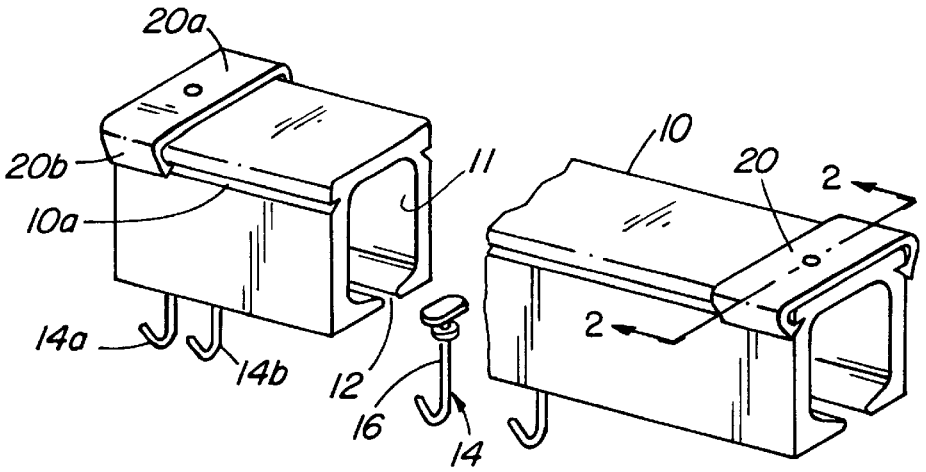
FIG. 1 is a perspective view of a first embodiment of the invention, cut-away to show internal structure.
Figure 2:
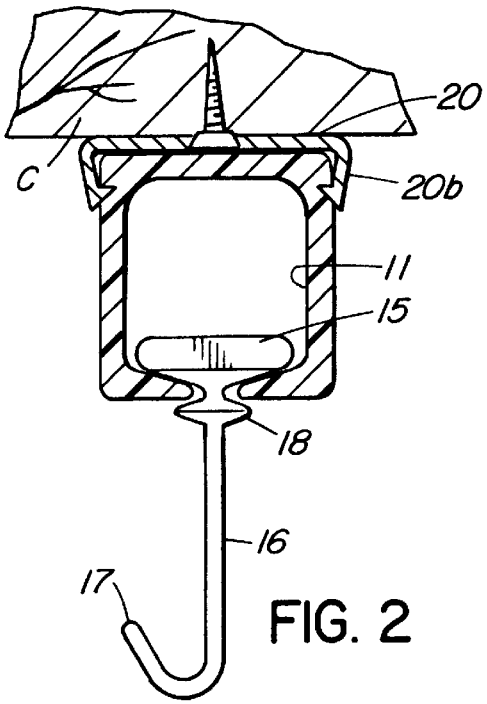
FIG. 2 is a cross-sectional view of the track member of FIG. 1, on lines 2—2 of FIG. 1, as attached to a ceiling.
Figure 3:
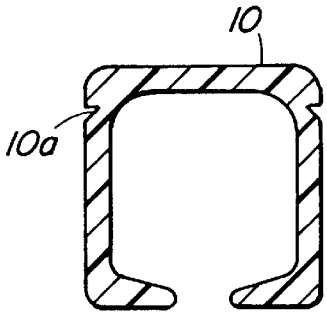
FIG. 3 is a cross-sectional view through the track member of FIG. 1.
Figure 4:
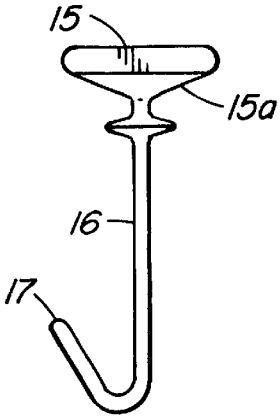
FIGS. 4 and 5 are front and side views of a hook element used in the embodiment of FIG. 1.
Figure 5:
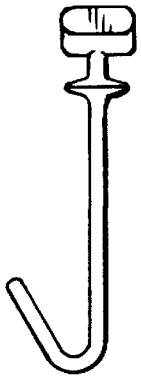

As shown in FIGS. 1 and 2, the apparatus comprises an elongated track member 10, formed from plastic material by extrusion, and having an elongated internal cavity 11 which occupies most of the cross-sectional area of the member. The lower part of the cavity forms a slideway and communicates with the underside of the track member via a slot 12 extending along the center of the bottom of the member.

Figure 7:
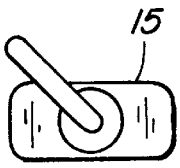

At intervals along the track member there are provided hook elements 14, 14*a,* 14*b,* etc., each having an anchor portion 15 which is rectangular in plan view, being elongated transversely to the longitudinal axis of the member, and having its center fixed to a shank 16 which extends out through the slot 12 and terminates in a lower bent over hook part 17. This hook part extends at least partially lengthwise of the track member, and preferably lies at about 45° to the longitudinal extent of the track member when seen in plan view, as in FIG. 7. This alignment is maintained by the engagement between the sloping shoulders 15*a* of the anchor 15, which rest and are slidable on similarly sloping internal surfaces of the cavity bordering the slot 12. The vertical position of the hook element in the track is maintained by a collar 18 surrounding the shank near the lower surface of the track member, and which holds the anchor 15 close to the slideway so that it cannot rotate. The hook elements may be integral moldings of plastic material.

At least some of the hook elements 14 are sized so that the outer end of the hook part 17 is between ½ inch and ¾ inch below the bottom of the track member, this being a size which allows the apertures of most carded merchandise to be easily slipped over the end of the hook part. Although only four of the hook elements 14 are shown, in practice many more, perhaps 20, 30, or more, will be provided on a single track member of 15 to 48 inches length.

It is also possible to provide larger hook elements having a hook part between about 1½ and 2 inches from the track member, and which are suitable for carrying small tools, such as wrenches, provided such tools have a suitable aperture or similar capability for fitting onto the hook part.

Figure 8:
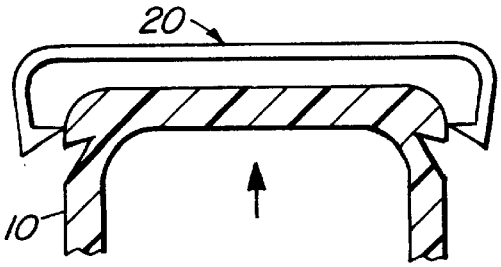
FIGS. 8 and 9 are partial cross-sectional views showing holding means for the track member.
Figure 9:
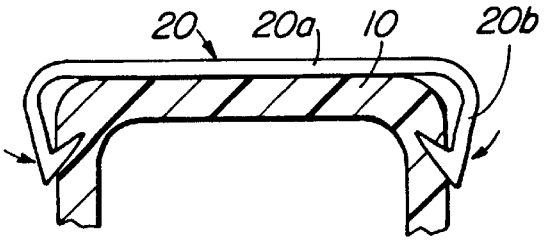

FIGS. 1 and 2 also show means for supporting the track element 10 from a ceiling, in the form of brackets 20 having a main central portion 20*a* with a screw hole for fixing the bracket in place under the ceiling C or similar horizontal surface, this main central portion joining two end portions in the form of spring jaws 20*b*. These are capable of grasping the upper portion of the member 10 by snap engagement in opposed slots 10*a* at opposite upper sides of the track member. The brackets, which are of metal or plastic, are such that they can be attached to the ceiling and the member 10 can subsequently be snapped into place, as illustrated in FIGS. 8 and 9.

Figure 6:
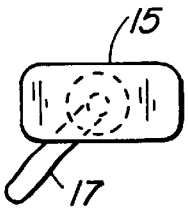
FIGS. 6 and 7 are top and bottom views of the same hook element.
Figure 10:
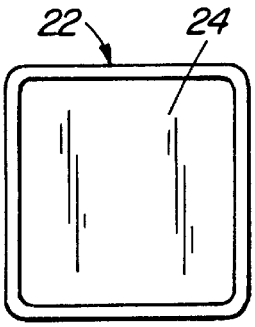
FIGS. 10, 11 and 12 are front, side, and rear views of an end cap for the track member.
Figure 11:
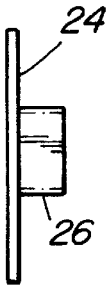
Figure 12:
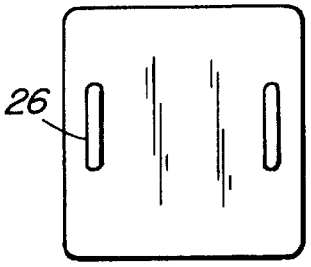

An important feature of this invention is that packaging of the components for sale is made easy and convenient by making the hook elements 14 such that they can be wholly packaged within the track member cavity 11. This is possible because the size of the hook elements, when seen in plan view, as in FIG. 6, is smaller than the cross-sectional size of the cavity, as seen in FIG. 2. To hold the hook elements within the cavity, two end caps 22 for the track member are provided, one of which is seen in FIGS. 10 to 12. Each end cap 22 is molded of plastic, and is in the form of a square plate 24 from which protrude two spaced parallel lugs 26. The lugs are spaced so as to be a friction fit in the sides of the cavity 11. The cap is effective both to retain the hook elements in the cavity when packaged therein, and to prevent the hook elements from coming out of the ends of the slot 12 when the hook elements have been properly positioned for normal use of the apparatus.

Figure 13:
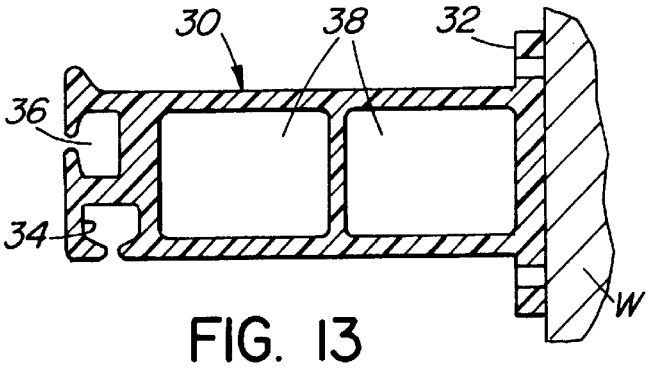
FIG. 13 is a cross-sectional view of an alternative form of the track member.
Figure 14:
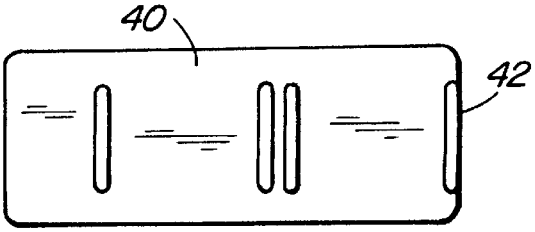
FIGS. 14 and 15 are rear and side views of an end cap for the track member of FIG. 13.

FIGS. 13 and 14 show an alternative form of the track member, which is useful in being equally suited to attachment to a wall or ceiling. As shown in FIG. 13, an extruded plastic track member 30 is generally rectangular in cross-section, having at one end flanges 32 with bores for receiving screws by which it can be attached (in the orientation shown) to a wall W. The outer edge of the track member has a first, lower cavity 34 communicating with the lower side of the member 30 via a slot 36. In the position shown, hook elements similar to the hook elements 14 already described can be held within the cavity 34, with the shanks of the hook elements projecting out of the slot. As mounted on a wall W as shown, the upper surface of the track member forms a small shelf.

The outer edge of the track member 30 also has a second cavity 36 which will communicate with the bottom of the track member when this is mounted, by the flanges 32, under a ceiling, in which position it carries the hook elements. Accordingly, this track member is suitable for both wall and ceiling applications.

Figure 15:
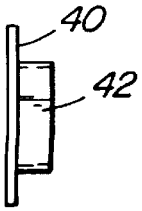

It may be noted that the cavities 34 and 36 in this member are relatively small. However, two much larger cavities 38 are provided which take up most of the internal space within the member, and either of these is large enough for hook elements to be packaged therein. FIGS. 14 and 15 show an end cap 40 for this arrangement, suitable both for retaining the hook elements when packaged in the track member, and also for preventing these from coming out in normal use. The end cap has lugs 42 which frictionally engage the inner surfaces of the cavities to retain it in position.

Figure 16:
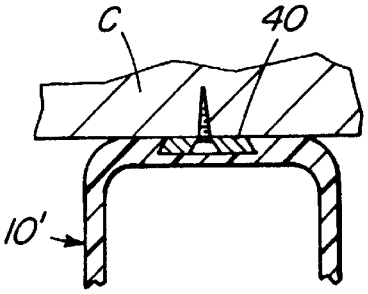
FIG. 16 is a cross-sectional view of alternate mounting means for a track member.

FIG. 16 shows an alternative mounting arrangement for the track member, indicated at 10', which is similar to member 10 but has a groove of dovetail-shaped cross-section in its upper surface. This is dimensioned to slidingly fit onto a mounting part 40 which has a complementary shape, i.e. outwardly sloping side surfaces. The part 40 is secured to the ceiling C by central screws, after which the member 10' is slid into place.

FIGS. 17 to 20 show a further, and preferred, version of the invention. As shown, the elongated track member 50, which is again formed from plastic material by extrusion, is of square cross-section, having an elongated internal cavity 51 occupying most of the cross-sectional area of the member. In this case the cavity communicates with an outer side surface of the member via a slot 52 extending along the top of the front side of the member, so that the lower edge of the slot is defined by the top of a sidewall portion 50*a* of the track member. The top and inside of this sidewall portion forms a slideway for anchor parts of hook elements 54, 54*a,* 54*b,* etc., each formed as a single piece of metal rod or wire, the anchor parts 55 in this case being bent over inner end retaining portions of the rods which engage the inner side and top of the wall portion 50*a*. These same rods also form the shanks 56 and the lower bent over hook parts 57 of the hook elements. The hook part 57 is similar to hook part 17, and similarly sized to receive the apertures of most carded merchandise. The hook parts are preferably twisted relative to the inner end retaining portions so as to lie in a plane at 45° to these latter portions. Again, it is also possible to provide larger hook elements which are suitable for carrying small tools.

Figure 17:
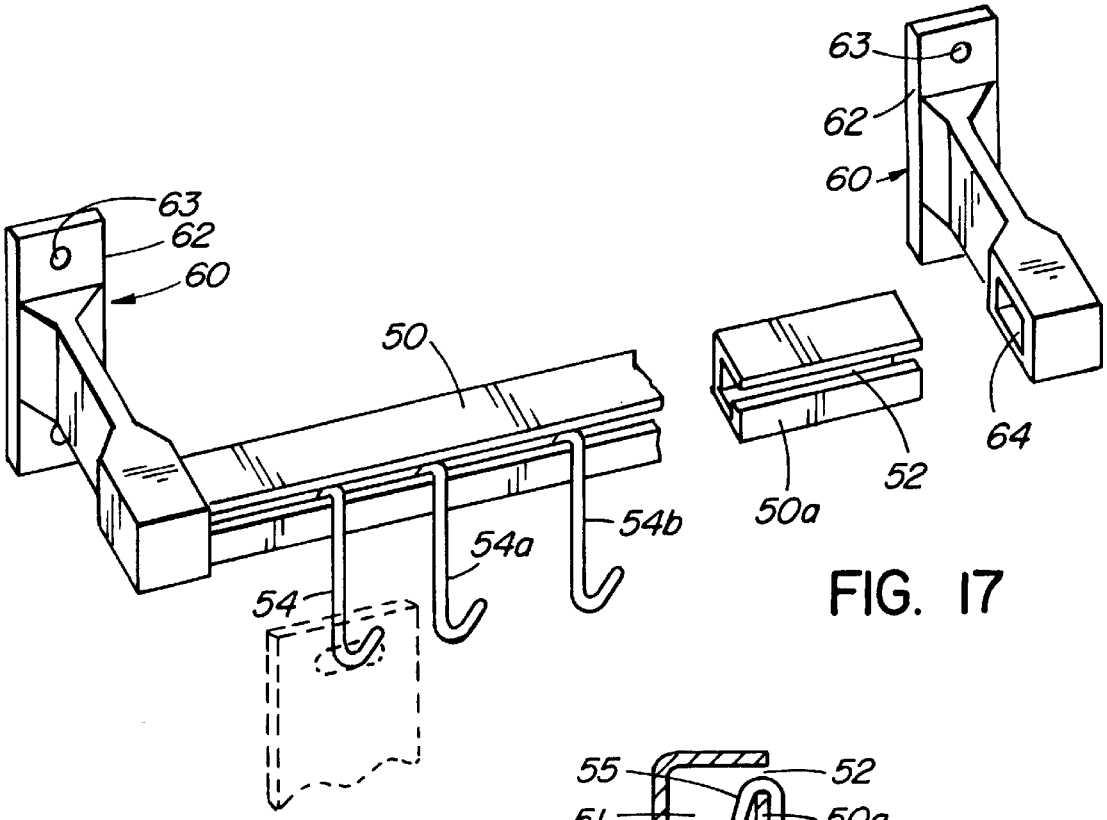
FIG. 17 is a perspective of yet another form of track member and of its supports.
Figure 18:
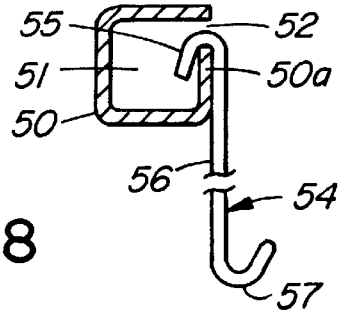
FIG. 18 is a cross-sectional view through the track member, showing a hook element in place.
Figure 19:
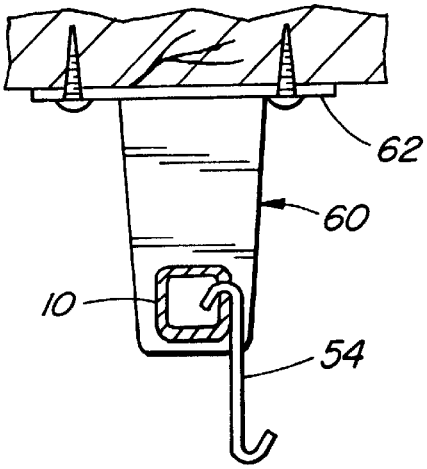
FIG. 19 is a similar view of the track member and which also shows the inside of a support bracket attached to a ceiling.
Figure 20:
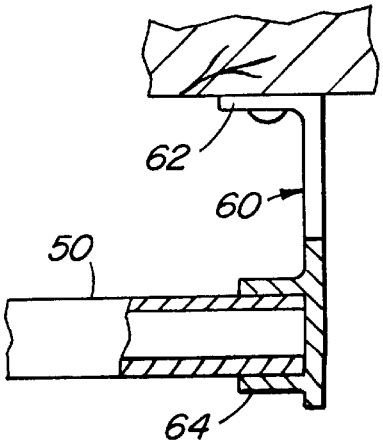
FIG. 20 is a partly sectioned side view of a modified support bracket and an end portion of the track member, when attached to a ceiling.

FIGS. 17 to 20 also show means for supporting the track element 50 from a wall or ceiling, in the form of two brackets 60 each having an inner end with spaced flanges 62, each flange having a screw hole 63 for fixing the bracket in place on a wall or ceiling. A wall mount is shown in FIG. 17, and ceiling mounts, of different designs, are shown in FIGS. 19 and 20. The brackets each have an outer end provided with a square socket 64 which can receive an end of the track member 50; the socket provides a closure for the end of the track member as well as a support. As will be evident from FIGS. 17, 19 and 20, the use of a square sectioned track member and square sockets in the brackets allows the same parts to be equally suitable for wall and ceiling mounting.

It will be seen that the arrangement of this invention solves the problem of storing items, particularly carded items, in a way which allows them to be easily stored, found and removed from storage.

I claim:

1. An arrangement for storing a variety of articles, including articles held by cards having apertures, comprising:

a normally horizontally extending elongated track member having elongated internal cavity means, said cavity means including a slideway communicating with an outside surface of the track member via a slot extending along the member, supporting means attachable to structure such as a wall or ceiling and capable of supporting the track member horizontally;

a series of hook elements each having an anchor part suitable for being slidably retained in said slideway while a shank of said element extends from said anchor part through said slot and terminates in a hook part outside said track member, said hook part being suitable for suspending said cards by said apertures while allowing individual removal thereof, said hook elements and said cavity means being dimensioned to allow the hook elements to be packaged entirely within said cavity means for shipping;

and wherein said anchor parts of said hook elements are non-circular and arranged to be non-rotatably held by the slideway, and wherein said hook parts extend at least partially lengthwise of the track member.

2. An arrangement, for storing a variety of articles, including articles held by cards having apertures, comprising:

a normally horizontally extending elongated track member having elongated internal cavity means, said cavity means including a slideway communicating with an outside surface of the track member via a slot extending along the member, supporting means attachable to structure such as a wall or ceiling and capable of supporting the track member horizontally;

a series of hook elements each having an anchor part suitable for being slidably retained in said slideway while a shank of said element extends from said anchor part through said slot and terminates in a hook part outside said track member, said hook part being suitable for suspending said cards by said apertures while allowing individual removal thereof, said hook elements and said cavity means being dimensioned to allow the hook elements to be packaged entirely within said cavity means for shipping;

wherein said track member is square in cross-section, and wherein said supporting means comprise two end brackets each having an inner end with means for attachment of the brackets to said structure, and each having an outer end provided with a square socket for receiving an end of said track member.

3. An arrangement for storing a variety of articles, including articles held by cards having apertures, comprising:

a normally horizontally extending elongated track member of square cross-section and having an elongated internal cavity, said cavity including a slideway communicating with an outside surface of the track member via a slot extending along a side of the member, the lower edge of said slot being defined by a side wall portion of the track member, supporting means comprising two brackets each having an inner end with means for attachment of the brackets to structure such as a wall or ceiling, and each having an outer end provided with a square socket for receiving an end of the track member, so that said brackets can support the track member horizontally and close ends of its cavity, and can support the track member with said slot located in its side whether attached to a wall or a ceiling, a series of hook elements each having a bent over inner end portion suitable for being slidably retained in said slideway while a shank of the hook element extends from said inner end portion through said slot and terminates in a hook part outside said track member, said hook part being suitable for suspending said cards by said apertures while allowing individual removal thereof, and wherein said hook elements and said cavity are dimensioned to allow the hook elements to be packaged entirely within said cavity for shipping.

* * * * *